United States Patent [19]

Kohno et al.

[11] Patent Number: 4,503,977

[45] Date of Patent: Mar. 12, 1985

[54] POSTAL MATTER SORTING APPARATUS

[75] Inventors: Takeshi Kohno, Yokohama; Kazuhito Haruki, Kawasaki; Yasuo Nagase, Tokyo, all of Japan

[73] Assignee: Tokyo Shibaura Denki Kabushiki Kaisha, Japan

[21] Appl. No.: 375,012

[22] Filed: May 5, 1982

[30] Foreign Application Priority Data

May 19, 1981 [JP] Japan ..... 56-75160

[51] Int. Cl.[3] ..... B07C 3/06

[52] U.S. Cl. ..... 209/564; 198/357; 198/366; 198/370; 209/584; 209/900

[58] Field of Search ..... 209/552, 559, 563-565, 209/569, 583, 584, 651, 656, 933, 900, 925; 414/136; 382/7, 13; 250/557; 198/357, 366, 370

[56] References Cited

U.S. PATENT DOCUMENTS

| | | | |
|---|---|---|---|
| 3,184,061 | 5/1965 | Levy | 209/900 |
| 3,573,748 | 4/1971 | Holme | 414/134 |
| 3,782,541 | 1/1974 | Wood | 209/900 |

OTHER PUBLICATIONS

IBM Technical Disclosure Bulletin; vol. 13, No. 5, Oct. 1970, pp. 1345-1348.

*Primary Examiner*—David A. Scherbel
*Assistant Examiner*—Donald T. Hajec
*Attorney, Agent, or Firm*—Finnegan, Henderson, Farabow, Garrett & Dunner

[57] ABSTRACT

An apparatus for sorting postal matter or mail to a plurality of stacking bins arranged in a row in accordance with the result of optically scanning and reading ZIP codes and taking out the mail from the stacking bins to a conveyance section arranged along the row of stacking bins whenever a predetermined amount of mail is stacked in a stacking bin. When the sorting operation has come to an end, the mail sorting apparatus detects if there exists any mail on the conveyance section, and takes out the mail from the stacking bins which are opposite to the empty region on the conveyance section downstream the position where mail is on the conveyance path. After the conveyance section moves and there is an empty region opposite to the stacking bin, it then takes out the mail from the stacking bin which was opposite to the position where there was mail. This method is repeated until all mail is removed from the stacking bins.

12 Claims, 29 Drawing Figures

FIG. 9A 10 14

| | | | | | | | | | | | | | | | |
|---|---|---|---|---|---|---|---|---|---|---|---|---|---|---|---|
| | | | | | | $X_2$ | | | | | $X_1$ | | | | |
| | | | | $Y_2$ | | | | | $Y_1$ | | | | | | |
| | | | | | | | $Z_1$ | | | | | | | | |

FIG. 9B 10 14

| | | | | | | | | | | | | | | | |
|---|---|---|---|---|---|---|---|---|---|---|---|---|---|---|---|
| | | | | | | $X_2$ | | | | | $X_1$ | $A_4$ | $A_3$ | $A_2$ | $A_1$ |
| | | | | $Y_2$ | | | | | $Y_1$ | $B_6$ | $B_5$ | $B_4$ | $B_3$ | $B_2$ | $B_1$ |
| | | | | | | | $Z_1$ | $C_8$ | $C_7$ | $C_6$ | $C_5$ | $C_4$ | $C_3$ | $C_2$ | $C_1$ |

FIG. 9C

14

| | | | | | | | | | | | | | | | |
|---|---|---|---|---|---|---|---|---|---|---|---|---|---|---|---|
| | | | | | | | $X_2$ | | | | | $X_1$ | $A_4$ | $A_3$ | $A_2$ | $A_1$ |
| | | | | | $Y_2$ | | | | | $Y_1$ | $B_6$ | $B_5$ | $B_4$ | $B_3$ | $B_2$ | $B_1$ |
| | | | | | | | | $Z_1$ | $C_8$ | $C_7$ | $C_6$ | $C_5$ | $C_4$ | $C_3$ | $C_2$ | $C_1$ |

FIG. 9D

14

| | | | | | | | | | | | | | | | | |
|---|---|---|---|---|---|---|---|---|---|---|---|---|---|---|---|---|
| | | | | | | | $X_2$ | $A_8$ | $A_7$ | $A_6$ | $A_5$ | $X_1$ | $A_4$ | $A_3$ | $A_2$ | $A_1$ |
| | | | | | $Y_2$ | $B_{10}$ | $B_9$ | $B_8$ | $B_7$ | $Y_1$ | $B_6$ | $B_5$ | $B_4$ | $B_3$ | $B_2$ | $B_1$ |
| $C_{16}$ | $C_{15}$ | $C_{14}$ | $C_{13}$ | $C_{12}$ | $C_{11}$ | $C_{10}$ | $C_9$ | $Z_1$ | $C_8$ | $C_7$ | $C_6$ | $C_5$ | $C_4$ | $C_3$ | $C_2$ | $C_1$ |

FIG. 9E

14

| | | | | | | | | | | | | | | | | | |
|---|---|---|---|---|---|---|---|---|---|---|---|---|---|---|---|---|---|
| | | | | | | | | $X_2$ | $A_8$ | $A_7$ | $A_6$ | $A_5$ | $X_1$ | $A_4$ | $A_3$ | $A_2$ | $A_1$ |
| | | | | | | $Y_2$ | $B_{10}$ | $B_9$ | $B_8$ | $B_7$ | $Y_1$ | $B_6$ | $B_5$ | $B_4$ | $B_3$ | $B_2$ | $B_1$ |
| | $C_{16}$ | $C_{15}$ | $C_{14}$ | $C_{13}$ | $C_{12}$ | $C_{11}$ | $C_{10}$ | $C_9$ | $Z_1$ | $C_8$ | $C_7$ | $C_6$ | $C_5$ | $C_4$ | $C_3$ | $C_2$ | $C_1$ |

FIG. 9F

14

| | | | | | | | | | | | | | | | | | |
|---|---|---|---|---|---|---|---|---|---|---|---|---|---|---|---|---|---|
| $A_{16}$ | $A_{15}$ | $A_{14}$ | $A_{13}$ | $A_{12}$ | $A_{11}$ | $A_{10}$ | $A_9$ | $X_2$ | $A_8$ | $A_7$ | $A_6$ | $A_5$ | $X_1$ | $A_4$ | $A_3$ | $A_2$ | $A_1$ |
| $B_{16}$ | $B_{15}$ | $B_{14}$ | $B_{13}$ | $B_{12}$ | $B_{11}$ | $Y_2$ | $B_{10}$ | $B_9$ | $B_8$ | $B_7$ | $Y_1$ | $B_6$ | $B_5$ | $B_4$ | $B_3$ | $B_2$ | $B_1$ |
| | $C_{16}$ | $C_{15}$ | $C_{14}$ | $C_{13}$ | $C_{12}$ | $C_{11}$ | $C_{10}$ | $C_9$ | $Z_1$ | $C_8$ | $C_7$ | $C_6$ | $C_5$ | $C_4$ | $C_3$ | $C_2$ | $C_1$ |

POSTAL MATTER SORTING APPARATUS

BACKGROUND OF THE INVENTION

This invention relates to postal matter or mail sorting apparatus for automatically sorting postal matter such as letter mail in accordance with the result of reading recognition of ZIP codes provided on the surfaces of the postal matter.

Various types of automatic postal matter processors have been proposed in order to save labor involved in work related to mailing service. One known type of automatic sorting apparatus described, for example, in British Patent No. 1527377, includes a code reader for automatically reading the ZIP codes on the postal matter and a plurality of stacking bins arranged in rows for stacking the postal matter in accordance with the read-out ZIP codes. (For convenience the terms "postal matter" and "mail" will be used interchangeably to include broadly card, letter and periodical mail). However, with such conventional automatic sorting apparatus, the mail stacked at the bins is taken out of the bins manually by operators. The mail from each bin is then bound together with an address card identifying the proper ZIP code.

Therefore, the operators must manually withdraw the postal matter from the sorting apparatus which requires much walking and exertion to keep up with the sorting operation. Moreover, the efficiency of handling the mail is not good.

In view of the above, a sorting apparatus having an automatic push-out mechanism for pushing out the postal matter stacked in the stacking bins has recently been developed. In this kind of sorting apparatus, every time that a predetermined quantity of postal matter is stacked in a bin it is automatically pushed out from the stacking bin to the rear side thereof by the push-out mechanism. At the rear side of the stacking bins, a conveyance path is arranged parallel and adjacent to the row of stacking bins. The conveyance path conveys the postal matter taken out from the stacking bins in one direction to the binder unit.

When a particular sorting operation has come to an end, it is desirable that the postal matter stacked in each stacking bin is removed as a stack even if the predetermined amount of matter for a bin has not yet been reached. However, if any postal matter taken from a preceding bin is located on the conveyance path opposite a bin with letters in it, it is impossible to remove those letters at that time. Under these circumstances, the sorting apparatus controls the push-out mechanisms of the stacking bins such that the postal matter is pushed out of each stacking bin only after such postal matter as may previously have been on the conveyance path has moved to the end of the path. Alternatively, the postal matter can be taken out of all stacking bins except those bins blocked by postal matter on the conveyance path, and after that, the postal matter in the remaining stacking bins is taken out when the region on the conveyance path opposite to the remaining stacking bins is clear.

However, this is inconvenient in that it takes much time to take out all the postal matter from the stacking bins and the prior art apparatus does not work effectively.

SUMMARY OF THE INVENTION

It is an object of this invention to provide a postal matter sorting apparatus which can remove postal matter from the bins in a short time.

It is another object of this invention to provide a method for removing the postal matter from all stacking bins at the end of a sorting operation.

In accordance with the preferred embodiment, the postal matter sorting apparatus of this invention includes an optical scanning code reader for reading the ZIP codes on letters and other mail or postal matter, and a plurality of stacking bins arranged in a row for storing the postal matter in accordance with the ZIP codes. The postal matter is sorted to the stacking bins in accordance with the reading of the ZIP codes by the code reader.

Each of the stacking bins has a push-out mechanism for pusing out the postal matter from the stacking bins onto the conveyance path. The push-out mechanism pushes out the postal matter each time that a predetermined quantity of postal matter is stacked in the stacking bin.

A section forming a conveyance path for conveying the postal matter is provided adjacent the row of stacking bins. The postal matter taken out of the stacking bins is placed in trays on the conveyance section and conveyed in one direction to the end of the conveyance section.

At the end of the conveyance path, a control circuit develops an instruction to remove the postal matter from the trays.

The control circuit controls the push-out mechanisms. When there exists any postal matter on the conveyance path, the push-out mechanisms of the stacking bins opposite the occupied regions on the conveyance path will not operate to push out the mail matter. Rather, the operation of the push-out mechanisms of the stacking bin is delayed until the conveyance path has an empty region opposite to the stacking bin.

In accordance with the postal matter sorting apparatus of this invention, it becomes possible to ensure a speedy operation to remove the postal matter from the stacking bins and the efficiency of the sorting operation is enhanced.

BRIEF DESCRIPTION OF THE DRAWINGS

These and other objects and advantages of the invention will become more apparent and more readily appreciated from the following detailed description of the preferred embodiments of the invention taken in conjunction with the accompanying drawings, in which:

FIGS. 9A to 9F are schematic diagrams showing how the mail is pushed out into trays arranged vertically in three rows at the end of a sorting operation;

DETAILED DESCRIPTION OF THE PREFERRED EMBODIMENTS

Figure 1:
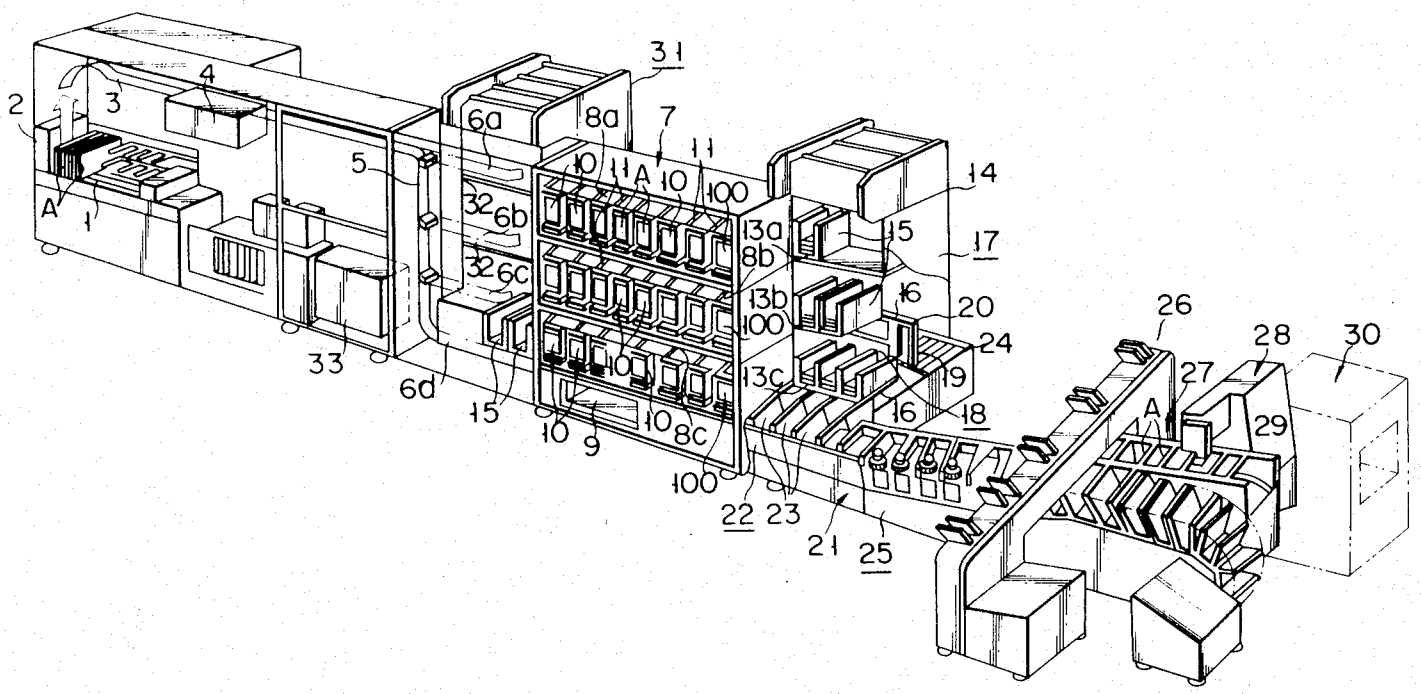
FIG. 1 is a perspective view showing a mail sorting apparatus according to the present invention.

Referring to FIG. 1, stacks of postal matter or mail such as cards and letters are placed vertically in the feeding section 1 and are sequentially picked up one at a time by pickup section 2 and conveyed along conveyance path 3 which can be a conveyance belt. The ZIP code on each piece of mail is read out at reading section 4 which is located on the conveyance path 3. Reading section 4 for instance can include an optical scanning system.

The pieces of mail are selectively conveyed by a gate mechanism 5 to the respective parallel sorting conveyance paths 6*a*, 6*b*, 6*c* and 6*d*, according to the readout from reading section 4. For instance, an initial sort may be made based upon the first digit of the ZIP code to one of the paths 6*a*, 6*b*, 6*c* or 6*d*. The sorted postal matter then moves to horizontal sorting conveyance paths 8*a*, 8*b* and 8*c* of sorting section 7 or to a reject pocket 9. Any rejected mail is manually sorted.

Sorting section 7, having a plurality of stacking bins 10 arranged adjacent the lower surfaces of horizontal sorting conveyance paths 8*a*, 8*b* and 8*c*, is equipped with an automatic push-out mechanism. Postal matter or mail A, fed to horizontal sorting conveyance paths 8*a*, 8*b* and 8*c*, is directed to predetermined stacking bins 10 to be stacked therein by controlling a gate mechanism 11 in accordance with the readout of reading section 4. Gate mechanisms 11 are arranged on sorting conveyance paths 8*a*, 8*b* and 8*c* in correspondence with each stacking bin 10.

When a suitable number of pieces of mail is stacked in a particular stacking bin 10 or a push-out switch (not shown) is depressed, a push-out mechanism (to be described later) operates to push out mail A from the stacking bin 10 to the rear side of sorting section 7. Each stack is pushed onto a tray 15 on one of the tray conveyance paths 13*a*, 13*b* or 13*c*, such paths being embodied as conveyor belts. The conveying portions of the sorting system move intermittently and synchronously, in a step-by-step movement, to allow for transfer of mail from bins and trays.

The tray conveyance section 14 (transferring section) operates with the horizontal tray conveyance paths 13*a*, 13*b* and 13*c* arranged vertically in three stages corresponding respectively to the horizontal sorting conveyance paths 8*a*, 8*b* and 8*c*. The stacks of mail A pushed out from stacking bins 10 are transferred to trays 15 which are moved intermittently from bin to bin along the respective horizontal tray conveyance paths 13*a*, 13*b* and 13*c*.

At the terminal end of horizontal tray conveyance paths 13*a*, 13*b* and 13*c*, an elevator 17 is arranged for vertical movement to sequentially move mail to opposing tray mounting tables 16. A tray 15 which has received the stack of mail A is circulated to the separating section of a mail/tray separating mechanism 18. At mail/tray separating mechanism 18, a postal matter push-out plate 19 and a tray pull plate 20 reciprocate. In the forward movement of these plates, the stack of mail A is pushed to the front to be fed to an aligned end converter 23 of an aligned end converting unit 22 which defines the forward end of a common conveyance line 21. In the backward movement to the rear side of the tray return path 24 the emptied trays move to the tray circulating section 14.

The stack of mail moves along conveyance line 21 to an aligning conveyance unit 25. During the movement in aligning conveyance unit 25, the end of the stack of mail A opposite to the direction of movement and one end of the stack perpendicular to the direction of movement are aligned. The aligned stack of postal matter A then moves to a separate conveyance line 27 by means of a transfer mechanism 26 which extends across and perpendicular to conveyance line 21. An address card 29 is automatically attached to the uppermost piece of mail in the stack by an address card issuance and attachment unit 28 which is arranged opposite conveyance line 21. The stack of mail A with address card 29 attached thereto is fed to a binder 30 which is located at the end of conveyance line 27 where the stack of mail A is bound with string or twine.

Tray 15 which is fed to tray return path 24 by mail/tray separating mechanism 18 is conveyed back to an elevator mechanism 31 which is arranged at the entry end of horizontal tray conveyance paths 13*a*, 13*b* and 13*c*. Tray 15 is then transferred to a tray mounting table 32 of elevator mechanism 31 by the tray transfer mechanism (not shown) which is located opposite the end of tray return path 24. Elevator mechanism 31 periodically moves the tray mounting table 32 in an endless rotational path to transfer trays from the end of return path 24 to the respective horizontal tray conveyance paths 13*a*, 13*b* or 13*c*. Trays 15 are pushed onto tray horizontal conveyance paths 13*a*, 13*b* or 13*c* sequentially by a push-in mechanism (not shown). During the operation, trays 15 on horizontal tray conveyance paths 13*a*, 13*b* and 13*c* are moved one pitch at a time (i.e. one tray width) and the tray 15 at the terminal end of the respective paths is transferred to tray mounting table 16 of elevator mechanism 17. The movement of trays 15 continues in a repetitious fashion over this path. The overall system is controlled by control section 33.

Figure 2:
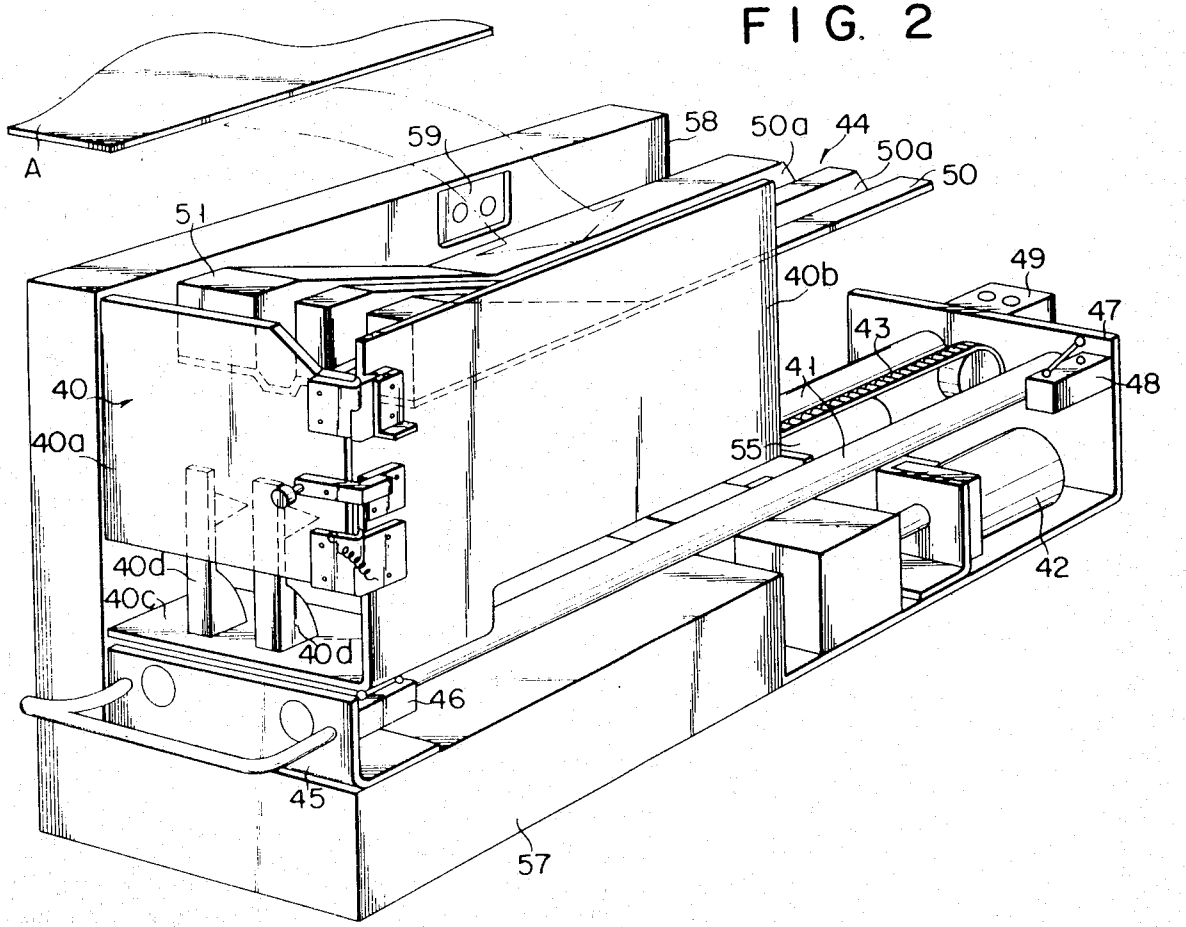
FIGS. 2, 3, and 4 are perspective views showing an individual stacking bin.
Figure 3:
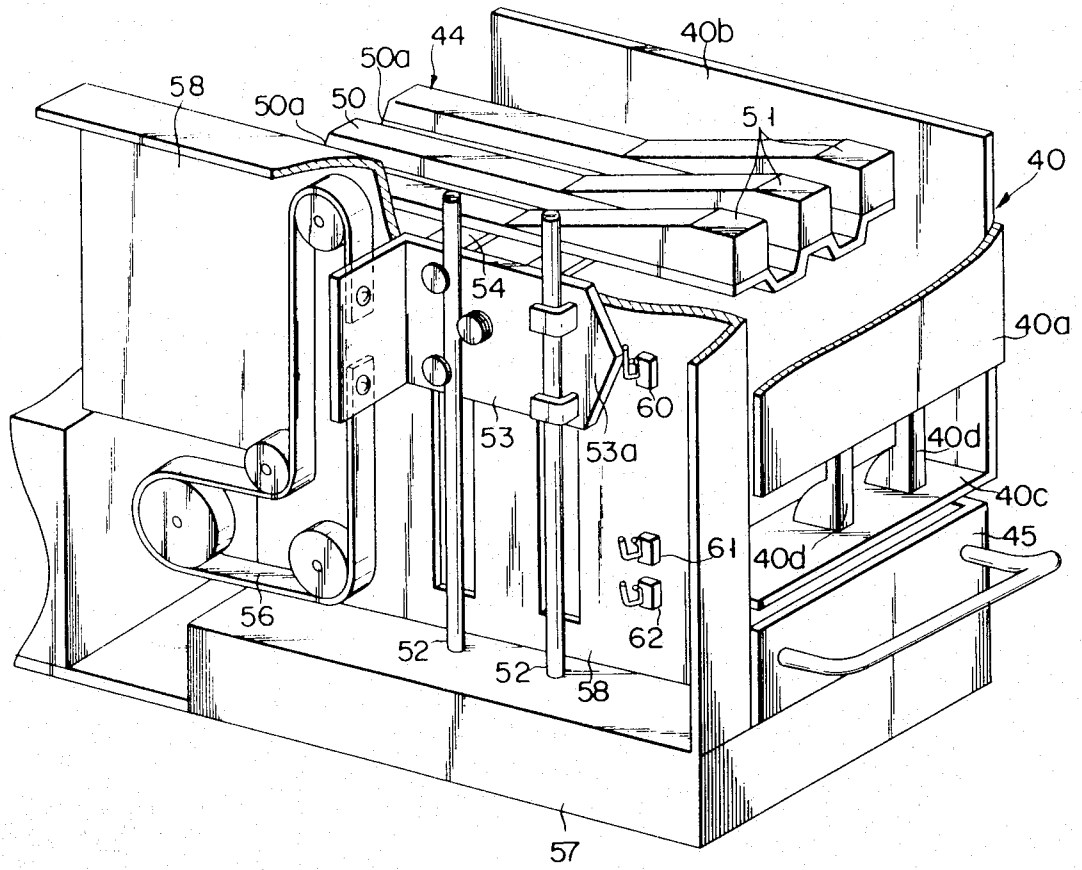
Figure 4:
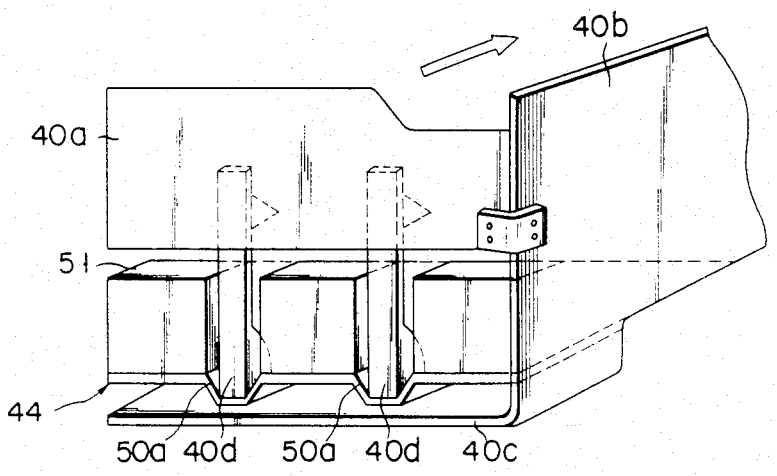

Stacking bins 10 will now be described in more detail with reference to FIGS. 2, 3, and 4.

A push-out section 40 includes a push-out plate 40*a* which also functions as a front cover, a side plate 40*b*, a bottom plate 40*c* and inclined holding members 40*d*. The inclined holding members 40*d* are fixed to push-out plate 40*a*, but are not directly fixed to bottom plate 40*c*. During the movement of section 40*a* the holding members 40*d* do not come in contact with the face of bottom plate 40*c*; rather a space exists between holding members 40*d* and bottom plate 40*c* nearly equal to the thickness of mounting table 44. During the push-out operation, push-out section 40 moves along the longitudinal direction of mounting table 44. Inclined holding members 40*d* are engaged with grooves 50*a* of mounting table 44 and move along grooves 50*a*, and bottom plate 40*c* moves under mounting table 44.

A belt 43 which is driven by a reversible motor 42 is coupled to bottom plate 40*c* of push-out section 40. When reversible motor 42 is driven in the forward or reverse direction, push-out section 40 moves along the longitudinal direction of mounting table 44 in the forward or reverse direction.

A stop-position detector 46 for detecting if push-out section 40 is in its stop position (stacking position of mail A) is arranged in the vicinity of plate 45 which supports guide rails 41. A return-position detector 48 for detecting if push-out section 40 is at its return position (push-out operation is completed) is arranged in the vicinity of a plate 47 supporting guide rails 41. Detectors 46 and 48 are turned on and off by interaction with projections (not shown) formed on bottom plate 40*c* of push-out section 40 in order to detect the position of push-out section 40. An empty-stack detector 49 for detecting if mail A is in tray 15 is arranged on plate 47 opposite to guide rails 41. Empty-stack detector 49 comprises, for example, a light-emitting element and a light-receiving element.

Mounting table 44 includes a plate with guide grooves 50*a* for guiding inclined holding member 40*d*, and inclined members 51 which are arranged at the top of the plate excluding guide grooves 50*a* and at the side of push-out plate 40*a*. Mail A is conveyed from horizontal sorting paths 8*a*, 8*b*, and 8*c*. Mounting table 44 is mounted on a lateral plate 54 which is fixed to a carriage 53 which is, in turn, supported by guide rails 52 to be vertically movable. A belt 56 which is driven by a reversible motor 55 is coupled to carriage 53. Mounting table 44 is moved up or down when reversible motor 55 is driven in the forward or reverse direction. A control circuit 57 for controlling overall stacking bins 10 is arranged below push-out section 40. A side plate 58 which opposes side plate 40*b* of push-out section 40 is arranged above control circuit 57. A postal matter detector 59 which detects mail A placed on mounting table 44 is arranged at the upper center of side plate 58. Postal matter detector 59 is a threshold reflecting type detecting element which consists of a light-emitting element and a light-receiving element. On side plate 58 are also arranged an upper limit detector 60, a full-stack detector 61, and a lower limit detector 62 which detect the position of mounting table 44 in accordance with the movement of carriage 53. Upper limit detector 60 detects if mounting table 44 is at the position of the upper limit (initial status). Full-stack detector 61 detects if mounting table 44 is full of postal matter. Lower limit detector 62 detects if mounting table 44 is at the lower limit position (push-out position). These microswitches are arranged along the path of movement of carriage 53 and are operated by interaction with a projection 53*a* of carriage 53.

Detectors 46, 48, 60, 61 and 62 respectively comprise microswitches.

Figure 5:
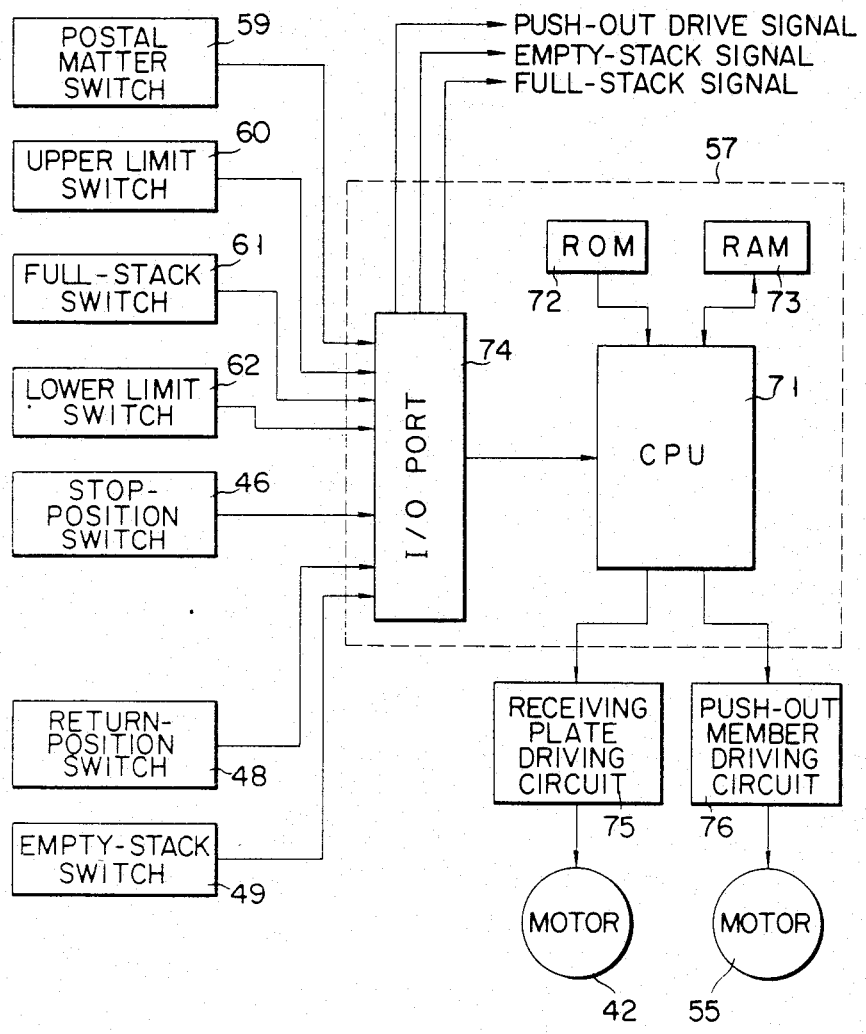
FIG. 5 is a block diagram of the control circuitry for the stacking bin section.

FIG. 5 shows the block diagram of the circuitry for controlling the operation of stacking bin 10. Control circuit 57 includes a central processing unit 71, a read-only memory (ROM) 72 for storing control programs, a random access memory (RAM) 73 for storing data to be processed, and an I/O port 74 for reading in the data from detectors 59 to 62, 46, 48 and 49.

When a predetermined amount of mail A is stacked on the mounting table 44, mail detector 59 detects its state and provides a postal matter detection signal to control circuit 57. Control circuit 57 drives motor 55 in the forward direction to lower mounting table 44 by a distance corresponding to the predetermined number of pieces or height of postal matter A. This operation is repeated each time mail collects to a height which is detected by detector 59. When mounting table 44 is lowered to the position of full-stack detector 61, full-stack detector 61 provides a detection signal to control circuit 57.

Control circuit 57 outputs to control section 33 a full-stack signal in response to the detection signal from full-stack detector 61. In response to the full-stack signal, a push-out drive signal is supplied to control circuit 57 from control section 33. Control circuit 57 drives motor 55 in the forward direction in response to the push-out drive signal. Then, mounting table 44 is lowered. When mounting table 44 is lowered to the position of lower limit detector 62, lower limit detector 62 produces a detection signal to control circuit 57. In response to the detection signal from lower limit detector 62, motor 42 is driven in the forward direction to move push-out section 40 in the forward direction. The inclined holding members 40*d*, moving over mounting table 40, push the mail forward to the tray 15. When the mail has been pushed out to the tray, control circuit 57 outputs to control section 33 an empty-stack signal in response to a detection signal produced by empty-stack detector 49.

When the push-out section 40 is moved to return-position detector 48, return-position detector 48 produces a detection signal to control circuit 57.

Control circuit 57 drives motor 55 in the reverse direction after a detection signal is supplied from return-position detector 48 to return mounting table 44 to the initial position. When a detection signal is supplied from the upper limit detector 60 motor 55 is turned off. Furthermore, control circuit 57 signals motor 42 to drive in the reverse direction to move push-out section 40 to its starting position. Motor 42 operates from the time the detection signal is supplied from return-position detector 48 until the time when a detection signal is supplied from stop-position detector 46.

Figure 6:
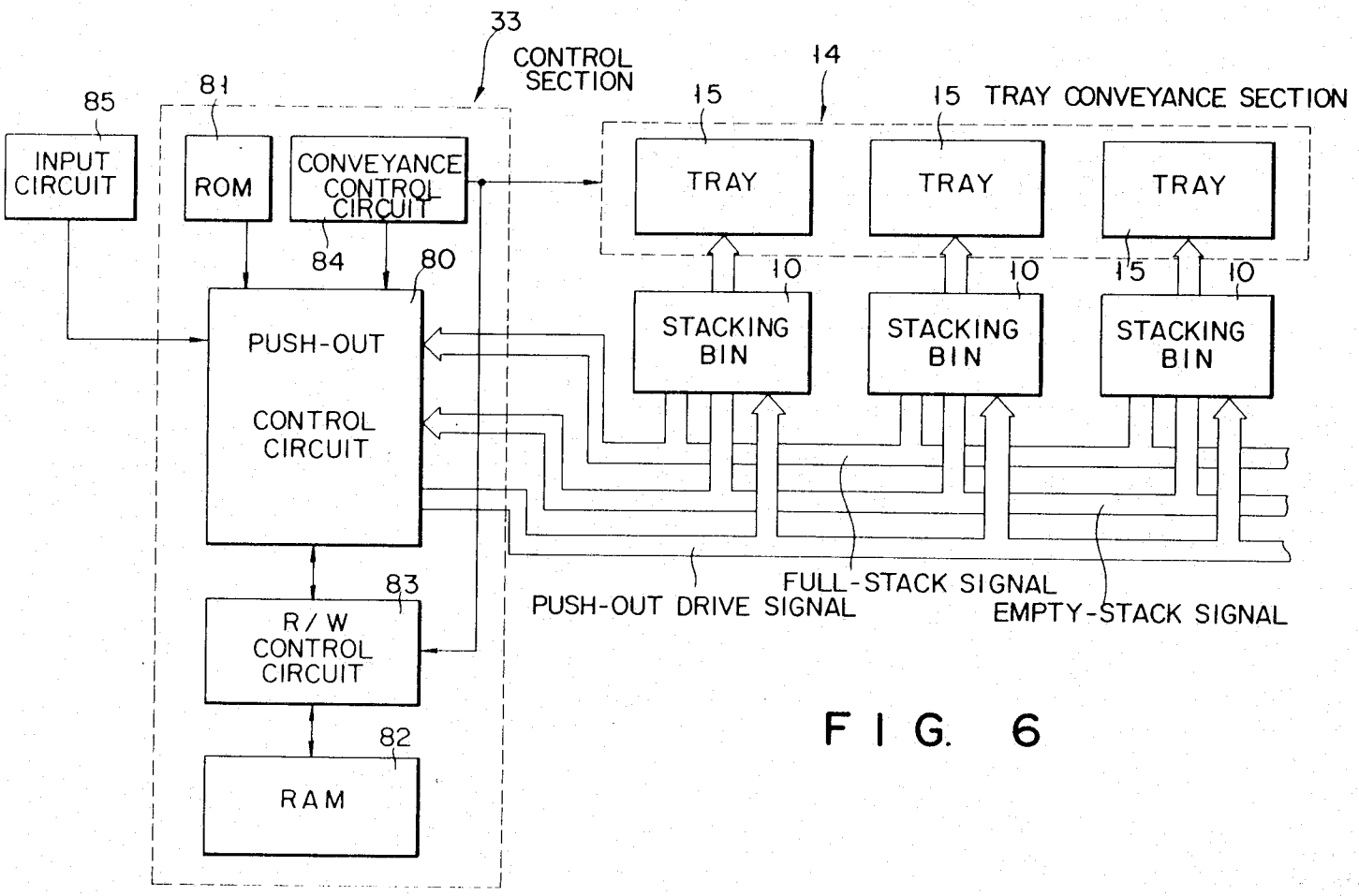
FIG. 6 is a block diagram of the circuitry of the control section.

FIG. 6 is a block diagram of the circuitry of control section 33. Control section 33 includes a push-out control circuit 80 for controlling the push-out operation of stacking bins 10, a read only-memory (ROM) 82 storing a push-out control program, a random access memory (RAM) 82 for memorizing the position of tray 15 in which the postal matter is placed, a read/write(R/W) control circuit 83 for RAM 82 and a conveyance control circuit 84 for controlling the operation of tray conveyance section 14.

Conveyance control circuit 84 produces a driving signal to tray conveyance section 14 in order to cause trays 15 to move intermittently in a stepping movement along the horizontal tray conveyance path. Push-out control circuit 80 receives the full-stack signal from the detectors on stacking bins 10 and produces the push-out drive signal to stacking bins 10. R/W control circuit 83 reads out information from RAM 82 to push-out control circuit 80 or writes information from push-out control circuit 80 into or unites information from push-out control circuit 80 RAM 82 in response to a command signal from push-out control circuit 80. The push-out control unit 80 can be a central processing unit having an I/O port, for example, 16 bits CPU (Z-8000) made by ZILOG. RAM 82 includes a plurality of memory addresses corresponding to each of trays 15 for memorizing which trays 15 are filled with mail. If a certain tray is filled with mail, a logic level, for example "1", is stored at the address of RAM 82 corresponding to the tray and if the tray is not filled with mail, a logic level "0" is stored. Since trays 15 are intermittently displaced in response to the driving signal from conveyance control circuit 84, the information stored in RAM 82 is rewritten such that the information stored at one address is displaced to an adjacent address by R/W control circuit 83 in response to the driving signal from conveyance control circuit 84.

When push-out control circuit 80 has received the full-stack signal from one of stacking bins 10 (which is designated stacking bin 10*a* hereinafter), push-out control circuit 80 produces the command signal to R/W control circuit 83 to read out the information from RAM 82. R/W control circuit 83 reads out the information to push-out control circuit 80 from the address of RAM 82 corresponding to the tray (hereinafter tray 15*a*) opposite to stacking bin 10*a* which has generated the full-stack signal.

Push-out control circuit 80 produces the push-out drive signal to stacking bin 10*a* after confirming that tray 15*a* is empty. If tray 15*a* is filled with mail, push-out control circuit 80 will produce the push-out drive signal to stacking bin 10*a* when an empty tray will have been moved to the back of stacking bin 10*a*.

When push-out operation of the mail is completed, the empty-stack signal is produced from detector 49 of stacking bin 10*a* and supplied to push-out control circuit 80 of control section 33. In response to the empty-stack signal, push-out control circuit 80 causes R/W control circuit 83 to write the logic signal "1" at the address of RAM 82 corresponding to the position of tray 15*a*.

Figure 7:
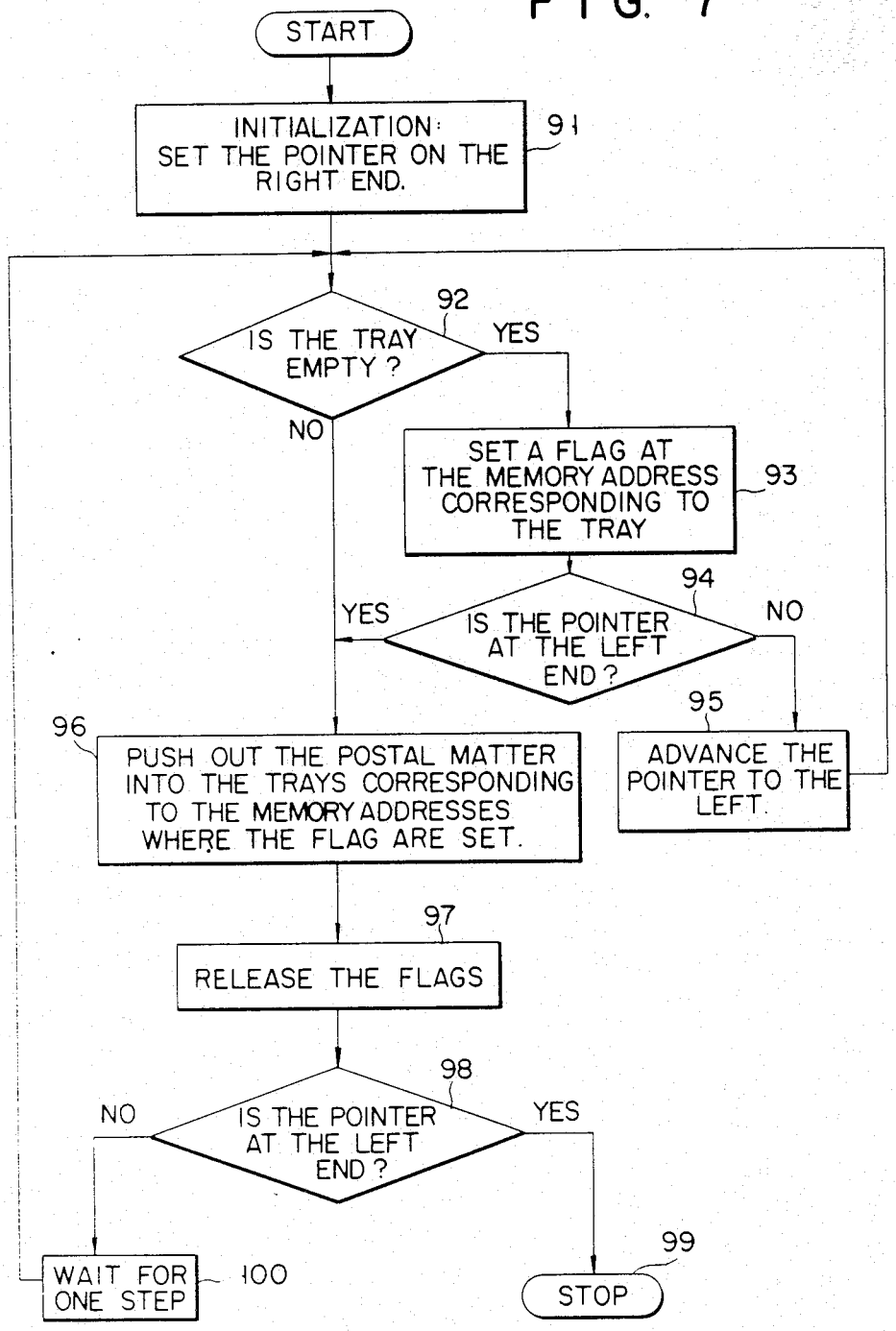
FIG. 7 is a flow chart of a push-out control program for controlling the mail push-out operation.

When the sorting operation has come to an end, a stop signal is produced by an input circuit 85 and supplied to push-out control circuit 80. In response to the stop signal, push-out control circuit 80 reads out the push-out control program from ROM 81. FIG. 7 shows a flow chart of the push-out control program stored in ROM 81. Push-out control circuit 80 operates in accordance with the push-out control program as follows.

Push-out control circuit 80 causes R/W control circuit 83 to read out the information from the address of RAM 82 corresponding to the tray located most downstream (right end) with respect to the tray conveyance direction by setting a pointer at the right end address (block 91). From the read-out information, push-out control circuit 80 detects whether the tray is empty (block 92). If the tray is empty, a push-out flag is set at the memory address corresponding to the empty tray (block 93). Then it is detected if the pointer is at the most upstream address (left end address) (block 94). When the pointer is not at the left end address, the pointer is advanced one memory address upstream or left (block 95) to read out the information therefrom. Push-out control circuit 80 detects again if the tray is empty from the read-out information.

If the tray is not empty, or the pointer is at the left end address, push-out control circuit 80 produces the push-out drive signal to stacking bins 10 corresponding to the memory addresses of RAM 82 where push-out flags are set, that is, stacking bins 10 opposite to the empty trays located downstream from the filled-up tray (block 96). In response to the push-out drive signal, stacking bins 10 push out the mail into trays 15.

The flags set the memory addresses and are released after the push-out operation (block 97). It is then detected whether the pointer is at the most upstream address (left end address) (block 98). If the pointer is at the left end address, the push-out operation is stopped (block 99). If the pointer is not at the left end address, the push-out operation is delayed while trays 15 are moving to the next position, the driving signal is supplied to push-out control circuit 80. In response to the driving signal, push-out control circuit 80 causes R/W control circuit 83 to read out the information from RAM 82 to detect if the tray is empty (block 92).

The push-out operation mentioned above is repeated hereafter in accordance with the push-out control program, and the postal matter, stacked in all stacking bins 10, is pushed out into trays 15.

Figure 8A:
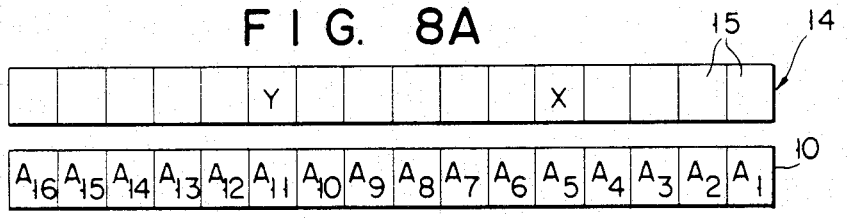
FIGS. 8A to 8F are schematic diagrams explaining the step-by-step mail push-operation.
Figure 8B:
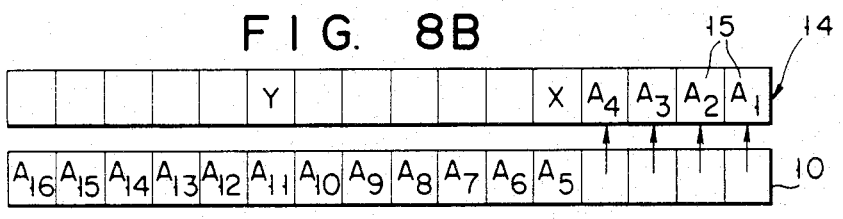

FIGS. 8A to 8F are schematic time diagrams explaining the push-out operation. In FIG. 8A, $A_1$ to $A_{16}$ designate the mail stacked in stacking bins 10 and X and Y designate trays 15 filled with mail; the other blocks in row 14 represent empty trays. According to the above-mentioned push-out operation, mail stacked in the stacking bins opposite to the empty trays which are located downstream from X, the first upstream tray filled with mail, is pushed out onto empty trays, that is, mail $A_1$ to $A_4$, respectively, as shown in FIG. 8B.

Figure 8C:
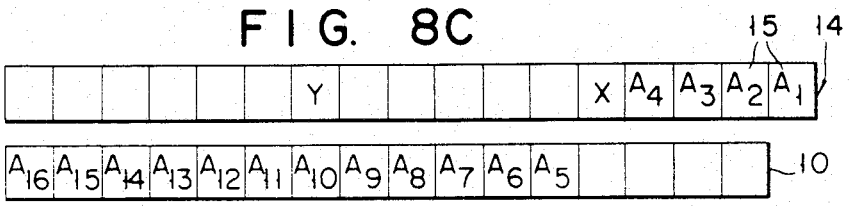
Figure 8D:
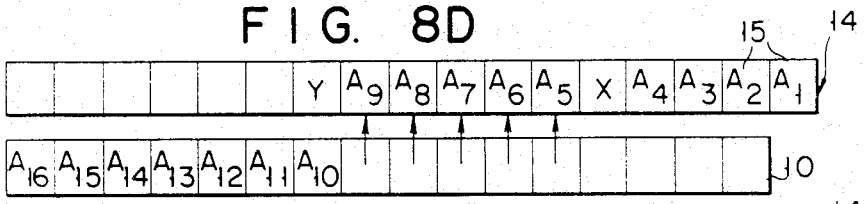

Then trays 15 are moved to the next position as shown in FIG. 8C. When trays 15 have been transferred to their respective next positions, mail $A_5$ to $A_9$ stacked in the stacking bins opposite the empty trays which are located downstream from the now next upstream filled tray is pushed out into the opposite trays, respectively, as shown in FIG. 8D.

Figure 8E:
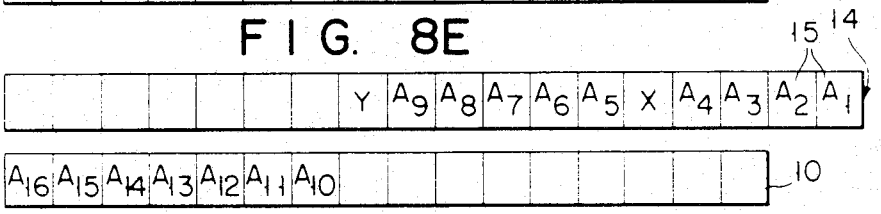
Figure 8F:
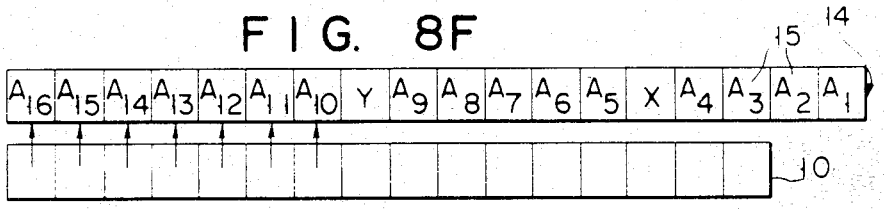

Then, the trays 15 move along the conveyance path to the next positions as shown in FIG. 8E. The remaining stacks of mail, i.e. $A_{10}$ to $A_{16}$ are pushed out into the respective opposite trays, as shown in FIG. 8F and the push-out operation is brought to completion.

In accordance with the push-out control as described above, it becomes possible to ensure a speedy operation to remove all the mail from the stacking bins at the completion of the sorting operation. Generally, in the case where N trays are filled with mail on the conveyance path, the push-out operation for all stacking bins is completed after the trays on the conveyance path have been conveyed (N+1) steps.

Accordingly, in the case where two trays filled with postal matter X and Y exist on the conveyance path as shown in FIG. 8A, the push-out operation of all stacking bins 10 is completed after the trays 15 on the conveyance path have been conveyed three steps. In accordance with prior methods, mail stacks $A_1$ to $A_{16}$ stacked in stacking bins 10 would all be pushed out of stacking bins 10 only after completion of the conveyance operation of postal matter Y.

Accordingly, the push-out operation would have been completed only after the trays had been conveyed twelve steps. The method for pushing-out the mail to the trays of the present invention ensures a speedy push-out operation. Moreover, the mail is taken out of tray conveyance section 14 continuously without interruption to binder 30 through conveyance lines 21 and 27. Accordingly, the mail stacks may be transferred and bound in a short time and the working efficiency of the sorting apparatus is enhanced.

In the embodiment of FIG. 1, stacking bins 10 are arranged horizontally in a row and vertically in three stages. The mail push-out operation described above for completing a sorting operation is performed independently for each stage as shown in FIGS. 9A to 9F. The process is shown in which the mail is pushed out into individual trays 15 arranged vertically in three stages corresponding to respective stacking bins. In this illustration, stacks of mail $X_1$, $X_2$, $Y_1$ and $Y_2$, and $Z_1$ exist in trays 15 of the third, second and first stages (on paths 8*a*, 8*b* and 8*c* respectively). This is shown in FIG. 9A, at the point of time when all the sorting of mail has come to an end and the individual mail stacks are to be removed and bound. Postal matter $C_1$ to $C_{16}$, $B_1$ to $B_{16}$ and $A_1$ to $A_{16}$ are pushed out into the first, second and third stages of trays from stacking bins 10, respectively, as shown in FIGS. 9B to 9F. The number of steps needed to the completion of the push-out operation is determined by the maximum number of trays filled with mail in any one of the stages at the point in time when it is decided to complete the operation and remove all stacks. In this illustration, the maximum number of steps needed to reach completion of the push-out operation is three.

Figure 10:
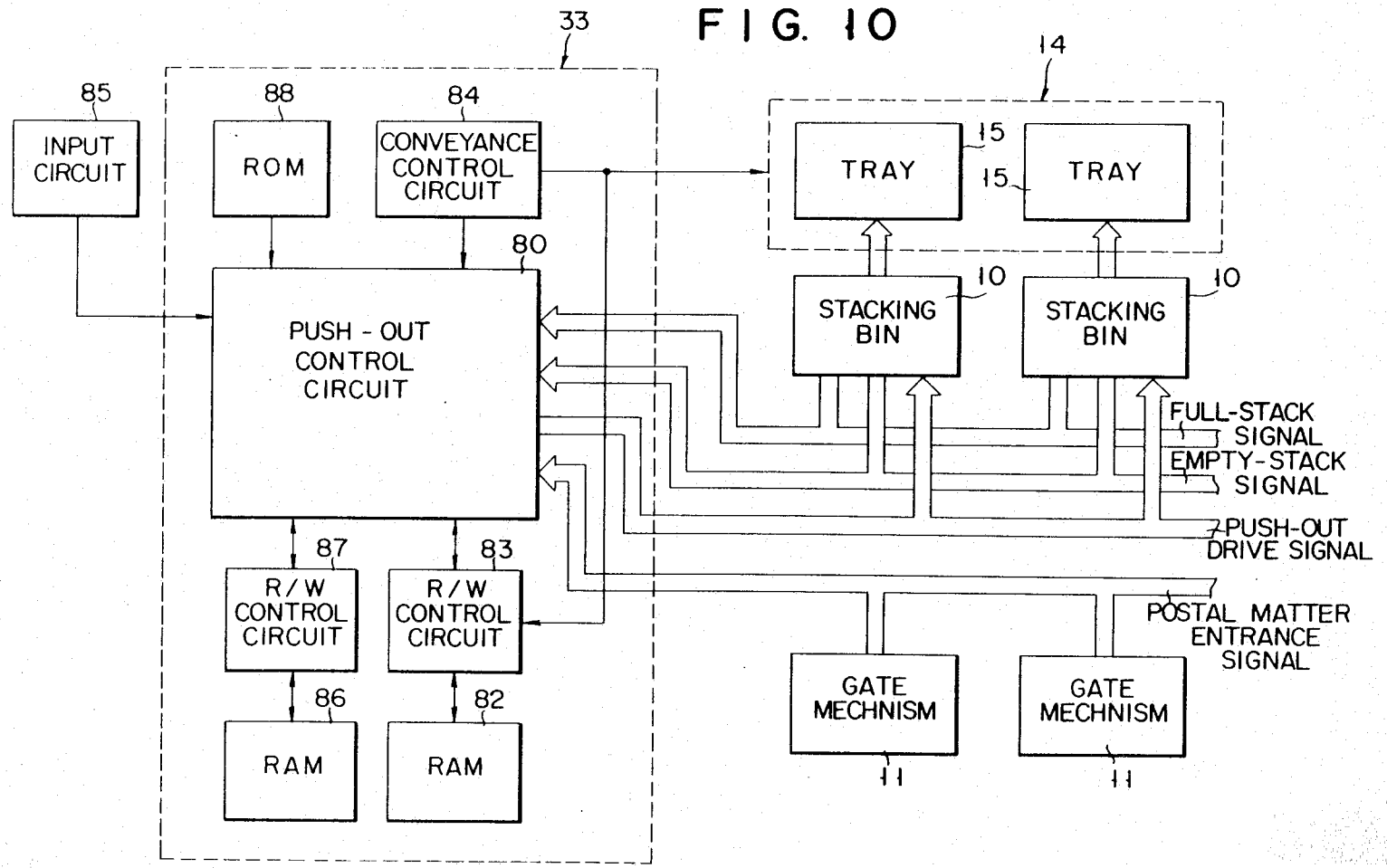
FIG. 10 is a block diagram of the circuitry of the control section according to another embodiment of this invention.

FIG. 10 shows a block diagram for a push-out control system of another embodiment according to the present invention. In FIG. 10, like reference characters designate similar parts to those in the embodiment of FIG. 6.

In this embodiment, control section 33 includes a random access memory (RAM) 86 having a plurality of memory addresses corresponding to the number of stacking bins 10 for memorizing which bins 10 have mail, a read/write(R/W) control circuit 87, and a read-only memory (ROM) 88 for storing a push-out control program. Push-out control circuit 80 receives a postal matter entrance signal beside the full-stack and empty-stack signals which are produced by gate mechanism 11 when the postal matter is put into a stacking bin 10. In response to the postal matter entrance signal, push-out control circuit 80 causes R/W control circuit 87 to write the information, for example logic "1", in the memory address of RAM 86 corresponding to stacking bin 10 in which the postal matter is placed. This information "1" is rewritten to the logic "0" by R/W control circuit B7 in response to the empty-stack signal when the postal matter has been pushed out.

Figure 11:
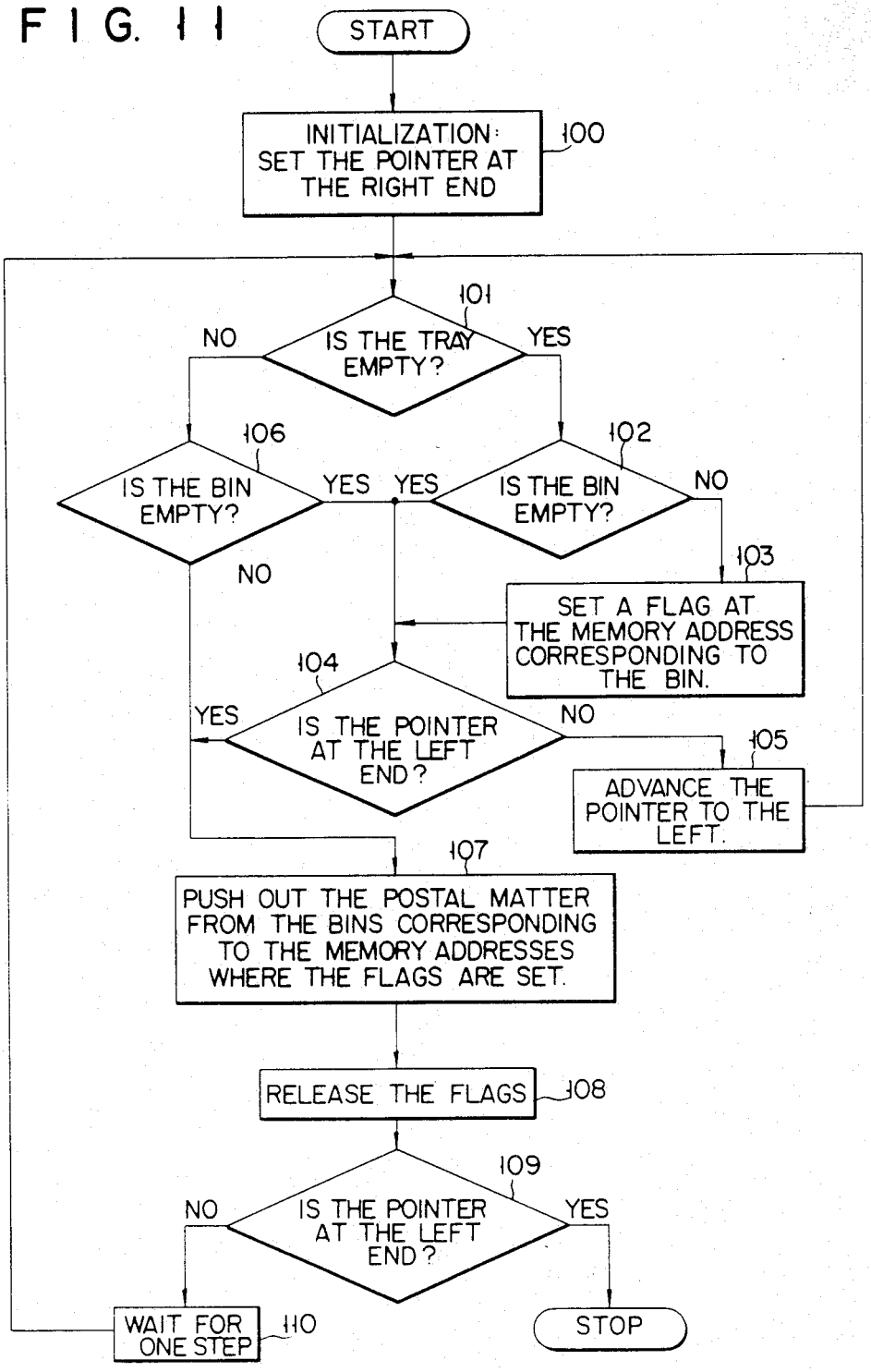
FIG. 11 is a flow chart of a control program for controlling the mail push-out operation being performed by the control section shown in FIG. 9.
Figure 12A:
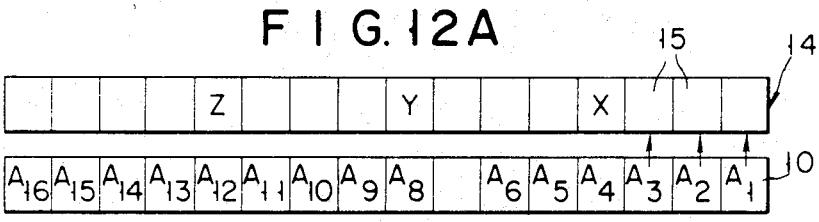
FIGS. 12A to 12C are schematic diagrams explaining the sequence of the mail push-out operation.

The push-out operation of the push-out control circuit is performed according to a program from ROM 88. FIG. 11 is a flow chart of the program stored in ROM 88. When the stop signal is supplied from input circuit 85 to push-out control circuit 80, push-out control circuit 80 causes R/W control circuits 83 and 87 to read out the information from RAMs 82 and 86, respectively, by setting pointers on the right end memory addresses, that is, the addresses corresponding to bin 10 and tray 15 located most downstream with respect to the tray conveyance direction (block 100). Push-out control circuit 80 detects if the tray is empty from the read-out information from RAM 82 (block 101). If the right end tray is empty as shown in FIG. 12A, push-out control circuit 80 then detects if the right end bin is empty from the read-out information from RAM 86 (block 102). If the right end bin is not empty, push-out control circuit 80 causes R/W control circuit 87 to set a push-out flag at the memory address corresponding to the bin (block 103). At the same time push-out control circuit 80 detects if the pointers are at the left end addresses of RAMs 82 and 86 (block 104). If the pointers are not at the left end addresses, push-out control circuit 80 causes R/W control circuits 83 and 87 to advance the pointers one memory address to the left (block 105) to read out the information from RAMS 82 and 86 again.

This operation of moving along the row 14 of trays and corresponding bins 10 is repeated as long as the tray is empty and the stacking bin is not empty. If the tray is not empty as designated at X in FIG. 12A, push-out control circuit 80 then detects if the stacking bin is empty (block 106). If the stacking bin is not empty as designated at $A_4$ in FIG. 12A, push-out control circuit 80 produces the push-out drive signal to the stacking bins corresponding to the memory addresses having push-out flags set (block 107), i.e. bins $A_1$–$A_3$. When the postal matter is pushed out of the stacking bins in response to the push-out drive signal, the push-out flags setting at the memory addresses are released (block 108). Then, push-out control circuit 80 detects if the pointers are at the left end memory addresses of RAMs 82 and 86. If the pointers are not at the left end memory addresses, push-out control circuit 80 waits for trays 15 to be conveyed one step (block 110). After trays 15 are conveyed one step as shown in FIG. 12B, push-out control circuit 80 detects again if the tray and bin are empty and performs the above-described program again.

Figure 12B:
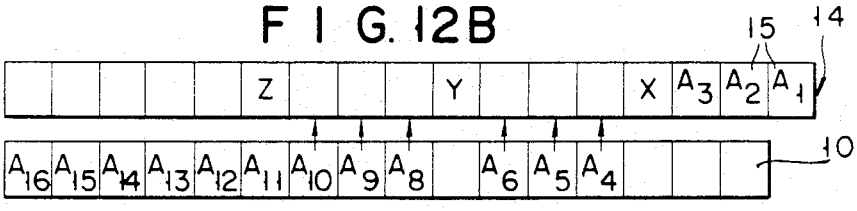
Figure 12C:
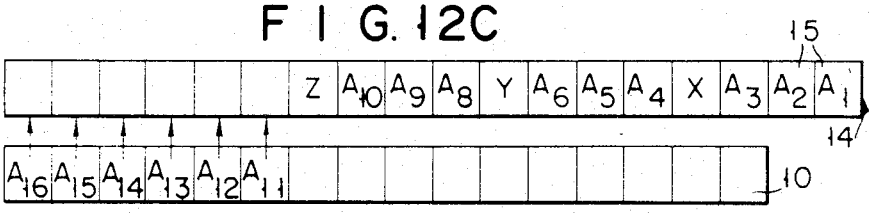

If both stacking bin and tray are empty, or the stacking bin is empty and the tray is not empty as shown in FIG. 12B, push-out control circuit 80 causes R/W control circuits 83 and 87 to advance the pointers. Accordingly, push-out control circuit 80 produces the push-out drive signal to the stacking bins $A_4$ to $A_{10}$ when push-out control circuit 80 has detected again that both stacking bin and tray have mail as shown in FIG. 12B. Push-out control circuit 80 then waits for trays 15 to be conveyed one step and operates according to the program described above again. When the pointers have come to the left end memory addresses, push-out control circuit 80 produces the push-out drive signal to push out the postal matter as shown in FIG. 12C and the push-out operation is completed.

Figure 13A:
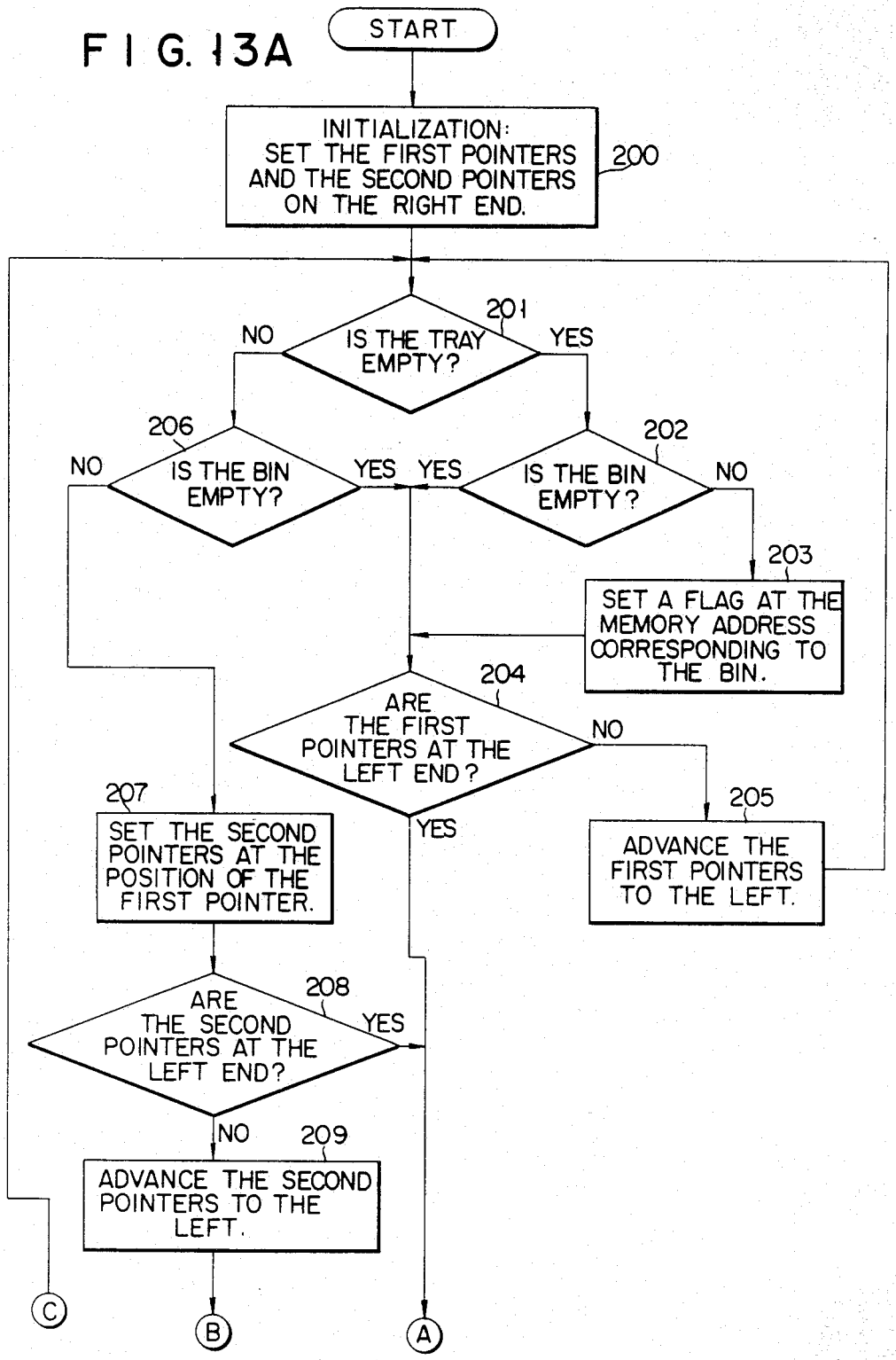
FIGS. 13A and 13B show a flow chart of another control program for controlling the push-out operation of the sorting apparatus shown in FIG. 9.
Figure 13B:
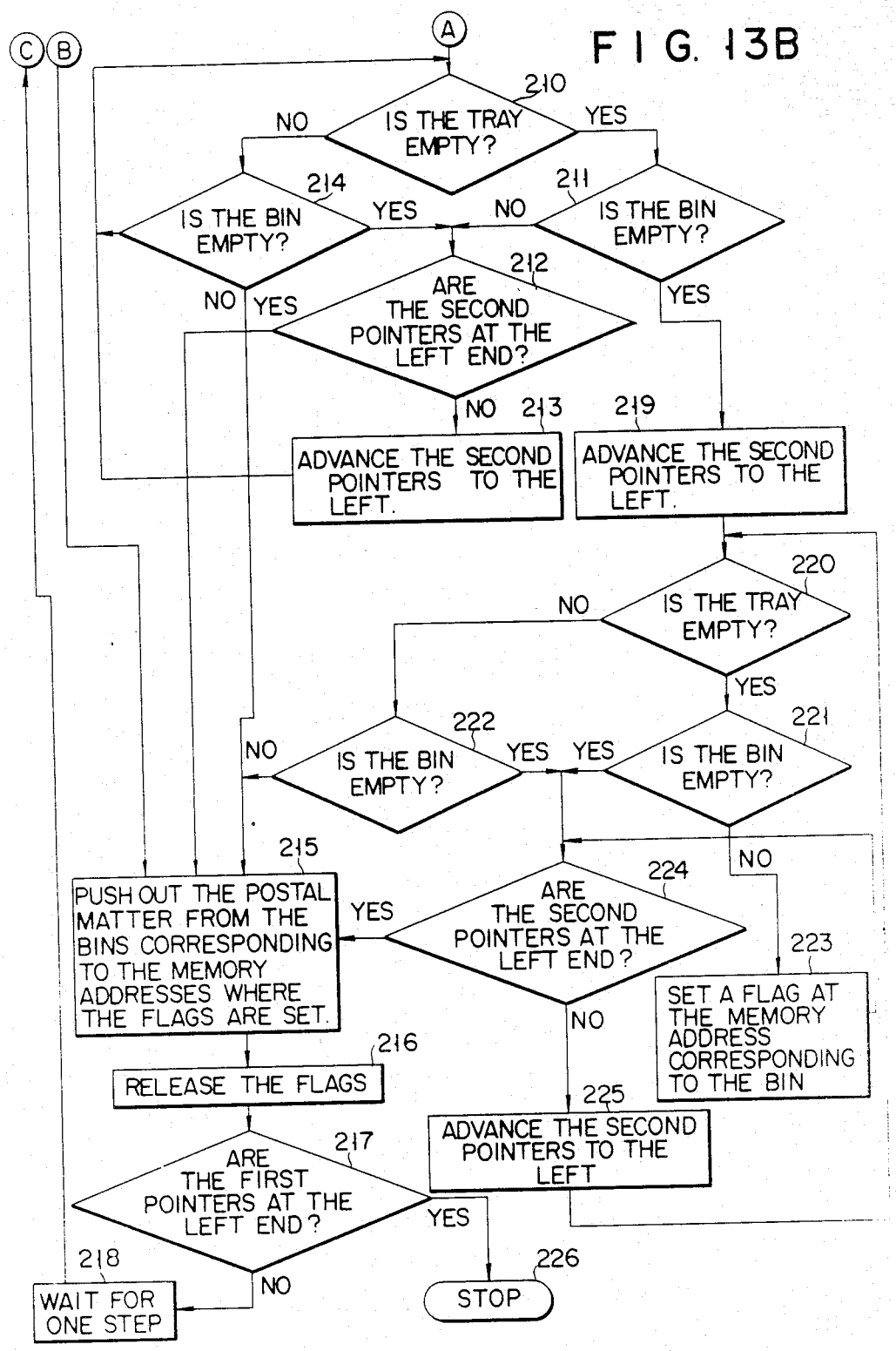
Figure 14A:
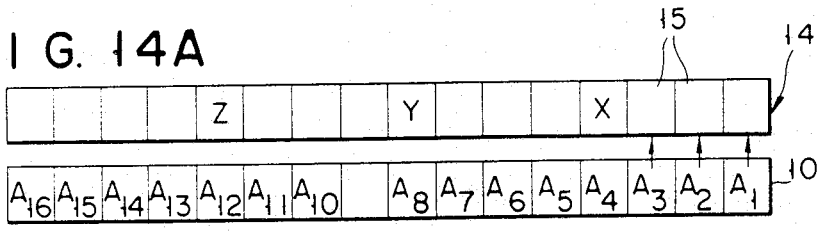
FIGS. 14A to 14C are schematic diagrams explaining the mail push-out operation by the control program shown in FIGS. 12A and 12B.
Figure 14B:
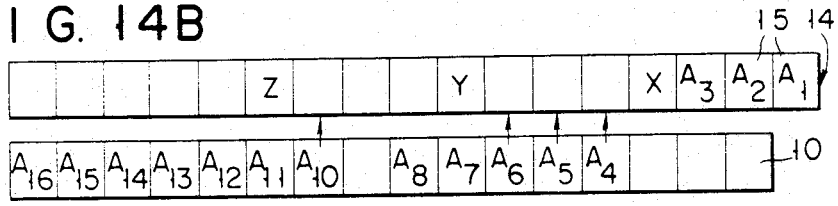
Figure 14C:
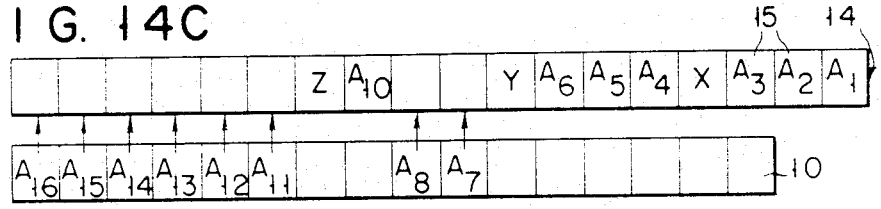

FIGS. 13A and 13B show a flow chart of another push-out control program which may be stored in ROM 88 shown in FIG. 10. The push-out control according to this control program can be explained with reference to the time charts as shown in FIGS. 14A–14C. Push-out control circuit 80 operates in accordance with the push-out control program as follows. When the stop signal is supplied from input circuit 85 to push-out control circuit 80, push-out control circuit 80 causes R/W control circuits 83 and 87 to read out the information from RAMs 82 and 86, respectively, by setting first and second pointers on each of the right end memory addresses, that is, the addresses corresponding to stacking bins 10 and trays 15 located most downstream with respect to tray conveyance direction (block 200) shown in FIG. 13A. Push-out control circuit 80 detects if the tray is empty from the read-out information from RAM 82 (block 201). If the right end tray is empty as shown in FIG. 14A, push-out control circuit 80 then detects if the right end stacking bin is empty from the read-out information from RAM 86 (block 202). If the right end stacking bin is not empty as shown in FIG. 14A, push-out control circuit 80 causes R/W control circuit 87 to set a push-out flag at the memory address corresponding to the stacking bin (block 203). At the same time push-out control circuit 8 detects if the first pointers are at the left end addresses of RAMS 82 and 86 (block 204). If the first pointers are not at the left end addresses, push-out control circuit 80 causes R/W control circuits 83 and 87 to advance the first pointers one memory address to the left (block 205) to read out the information from RAMs 82 and 86 again.

This operation is repeated as long as the tray is empty and the stacking bin is not empty. If the tray is not empty as designated at X in FIG. 14A, push-out control circuit 80 then detects if the stacking bin is empty (block 206). If the stacking bin is not empty as designated at $A_4$ in FIG. 14A, second pointers are set at the respective bin and tray positions of the memory addresses of RAMs 86 and 82 where the first pointers are set (block 207). Push-out control circuit 80 then detects if the second pointers are at the left end addresses of RAMs 82 and 86, and causes R/W control circuits 83 and 87 to advance the second pointers one memory address to the left when the second pointers are not at the left end memory addresses (blocks 208 and 209).

Push-out control circuit 80 detects if the tray is empty by reading out the information from the memory address of RAM 82 where the second pointer is set (block 210) shown in FIG. 13B. When the tray is empty, it is determined if the stacking bin is empty by reading out the information from the memory address of RAM 86 where the second pointer is set (block 211). If the stacking bin is not empty, it is determined if the second pointers are at the left end memory addresses of RAMs 82 and 86 (block 212). When the second pointers are not at the left end memory addresses, the second pointers are advanced one memory address to the left (block 213), and it is determined if the tray and the stacking bin are empty. The above-mentioned operation is repeated as long as the tray is empty and the stacking bin is not empty.

When both tray and stacking bin are not empty as designated at Y and $A_8$ in FIG. 14A, push-out control circuit 80 produces the push-out drive signal to the stacking bins corresponding to the memory addresses at which the push-out flags are set so as to push the mail $A_1$ to $A_3$ out from the stacking bins as shown in FIG. 14A (blocks 214 and 215). When the postal matter is pushed out of the stacking bins, the push-out flags previously set at the memory addresses are released (block 216). Push-out control circuit 80 then detects if the first pointers are at the left end memory addresses of RAMs 82 and 86 and when the first pointers are not at the left end memory addresses (block 218) waits for trays 15 to be conveyed one step as shown in FIG. 14B.

After trays 15 are conveyed one step, push-out control circuit 80 operates according to the program described above again. Accordingly, in the condition shown in FIG. 14A, the push-out flags are set at the memory addresses of RAM 86 corresponding to the stacking bins in which postal matter $A_4$ to $A_6$ is stacked and after the postal matter was detected both in the tray and the stacking bin as designated at Y and $A_7$ in FIG. 14B, it is detected if the tray and the stacking bin are empty by setting the second pointers. When no mail exists both in the tray and the stacking bin as shown in FIG. 14B, the condition is detected in blocks 210 and 211 shown in FIG. 14B. Then, the second pointers are advanced one memory address to the left (block 219) and it is determined if the tray and the stacking bin are empty (blocks 220 to 222). When the tray is empty and the stacking bin is not empty, the push-out flag is set at the memory address corresponding to the stacking bin (block 223). The second pointers are advanced one memory address to the left unless they are at the left end memory addresses (blocks 224 and 225), and it is determined if the tray and the stacking bin are empty.

When both the tray and the stacking bin are not empty as designated at Z and $A_{11}$ in FIG. 14B, the postal matter is pushed out from the stacking bins corresponding to the memory addresses where the push-out flags are set (blocks 220, 222 and 215). If the tray is not empty and the stacking bin is empty in blocks 220 and 222, it is determined whether the second pointers are at the left end memory addresses (block 224). When the second pointers are at the left end memory addresses, the mail is pushed out from the stacking bins, and if they are not, the second pointers are advanced one memory address to the left.

When the mail is pushed out from the stacking bins and the first pointers are not at the left end memory addresses, push-out control circuit 80 waits for trays to be conveyed one step and performs the program again from the beginning. Accordingly, in the condition as shown in FIG. 14C, the push-out flags are set at the memory address of RAM 86 corresponding to the stacking bins in which mail $A_7$ and $A_8$ is stacked. After the push-out flags were set as described above, push-out control circuit 80 detects the condition in which the stacking bin is empty, but the tray is not empty as designated at A and Z in FIG. 14C. Such condition is detected in blocks 201 and 206 shown in FIG. 13A. Then, it is determined if the first pointers are at the left end memory addresses in block 204. If the first pointers are not at the left end memory addresses, the first pointers are advanced to one memory address to the left, and then it is detected if the tray and stacking bin are empty in blocks 201, 202 and 206. Finally, when it is detected that the first pointers or the second pointers are at the left end memory addresses in blocks 204 and 208, the postal matter stacked in the stacking bins is pushed out. After the postal matter is pushed out, it is determined if the first pointers are at the left end memory addresses again. Then, when the first pointers are at the left end memory addresses, the whole push-out operation is stopped (block 226).

In accordance with the push-out control system described above, the mail may be taken out quickly and efficiently.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A mail sorting apparatus for sorting mail in accordance with codes on said mail detected by optically scanning said codes, comprising:

a plurlaity of stacking bins for receiving and storing said mail arranged in at least one row;

means for reading out the codes provided on the mail and distributing the mail to said stacking bins in accordance with said codes;

a push-out mechanism, provided on each of said stacking bins, for selectively pushing out mail for said stacking bins;

a conveyance section having a plurality of trays, forming a conveyance path along the row of said stacking bins, for receiving and conveying in a predetermined direction the mail taken out from said stacking bins;

means for detecting when a predetermined amount of the mail has been stacked in each of said respective stacking bins and producing a detection signal;

means for producing a stop signal when the mail sorting operation is stopped;

means for controlling the push-out operation of the mail from each of said bins to a respective tray, said control means including first means responsive to said detection signal for causing said push-out mechanisms to operate so as to take out the mail from said respective stacking bins to said trays when said predetermined amount of mail has been stacked in the bins, and second means for controlling the take-out of the mail in response to said stop signal, said second means detecting mail on said conveyance path, operating only the push-out mechanisms of the respective stacking bins which are opposite empty trays on the conveyance path in said predetermined direction from the region where there exists mail on the conveyance path so as to take out the mail from said stacking bins, and further operating the push-out mechanism of the stacking bin which is initially opposite the region on the conveyance path where there exists mail to take out mail from said stacking bin when the conveyance path subsequently has an empty region opposite said stacking bin due to movement in said predetermined direction; and means for receiving mail from each of said trays and binding said respective mail.

2. A mail sorting apparatus according to claim 1, wherein said second means of the control means comprises a random access memory having a plurality of memory addresses corresponding to a plurality of regions on said conveyance path opposite respective stacking bins for memorizing the regions on said conveyance path where there is mail taken out from the stacking bins;

a push-out control circuit for controlling the push-out of the mail from the stacking bins; and a read-only memory for storing a mail push-out control program for controlling said operation of the push-out control circuit.

3. A mail sorting apparatus according to claim 2, wherein the information stored in said random access memory is continuously rewritten according to the movement of the mail on said conveyance path.

4. A mail sorting apparatus for sorting mail in accordance with codes on said mail detected by optically scanning said codes, comprising:

means for reading out the codes provided on the mail; a plurality of stacking bins arranged in a row for stacking mail, said stacking bins each having detectors for detecting a predetermined amount of mail and producing a detection signal; and having push-out mechanisms for taking out the mail from said stacking bins;

means for sorting the mail to said stacking bins based on the codes read out by said reading means; a conveyance section forming a conveyance path along the row of said stacking bins for conveying the mail taken out from said stacking bins in a predetermined direction; means for producing a stop signal when the mail sorting operation is stopped; and control means for controlling the take-out operation of the mail comprising first means for operating said push-out mechanisms of said stacking bins in response to said detection signal, so as to take out the mail from said stacking bin to said conveyance section when said predetermined amount is stacked in said respective bins, and second means for controlling the take-out of mail in response to said stop signal, said second means detecting where mail is located on said conveyance path and in corresponding stacking bins starting from the most downstream region of said conveyance path in said predetermined direction, determining the first location of mail on said conveyance path and in the corresponding opposite stacking bin, operating the push-out mechanism of the respective stacking bins downstream of said first location, and further operating the push-out mechanism of the stacking bin which is initially opposite the region on the conveyance path having mail, to take out mail from said stacking bin when the conveyance path has an empty region opposite said stacking bin due to movement in said predetermined direction.

5. A mail sorting apparatus according to claim 4, wherein said second means of the control means comprises:

a first random access memory having a plurality of memory addresses corresponding to said plurality of stacking bins for memorizing the location of the respective bins having mail;

a second random access memory having a plurality of memory addresses corresponding to a plurality of regions on said conveyance path opposite said stacking bins for memorizing the position of the mail on said conveyance path;

a push-out control circuit for controlling the take-out of the mail from said stacking bins to said conveyance path, and a read only memory for storing a mail take-out control program;

said push-out control circuit operating in accordance with said mail take-out control program of said read-only memory, detecting where mail is located on said conveyance path and in said stacking bins by reading out the information from said first and second random access memories starting from the memory addresses corresponding to regions on said conveyance path and said stacking bin most downstream in said predetermined direction and controlling the take-out operation in response to the stop signal.

6. A mail sorting apparatus according to either claim 1 or 4, wherein said stacking bins are arranged in a plurality of parallel stages, each stage comprising a row aligned with the predetermined direction of said conveyance path.

7. A mail sorting apparatus according to either claim 1 or 4, wherein said conveyance means comprises a plurality of trays arranged opposite said stacking bins, said trays being conveyed in a stepping movement along the row of said stacking bins.

8. A mail sorting apparatus according to claim 5, wherein the information stored in said second random access memory is continuously rewritten according to the movement of the mail, on said conveyance path.

9. A method for taking out mail used with a postal matter sorting apparatus which comprises means for reading out codes provided on the surfaces of the mail, a plurality of stacking bins arranged in a row for stacking the mail, said stacking bins each having push-out mechanisms for taking out the mail from said stacking bins, means for sorting the mail to said stacking bins based on the codes read out by said reading means, and a conveyance section forming a conveyance path along the row of said stacking bins for conveying the mail taken out from said stacking bins in a predetermined direction, said method comprising the steps of:

detecting the location of mail taken out from said stacking bins on said conveyance path;

operating the push-out mechanism of the respective stacking bins which are opposite empty regions on the conveyance path downstream of the first location of mail on the conveyance path so as to take out the postal matter from said respective stacking bins; and operating the push-out mechanism of the stacking bin which is initially opposite the region on said conveyance path where the mail was located when the conveyance path has an empty region opposite to said stacking bin due to movement in said predetermined direction.

10. The method of claim 9 wherein the steps are repeated until all mail is taken out from the stacking bins.

11. A method for taking out mail using a mail sorting apparatus which comprises means for reading out codes provided on the surfaces of the mail, a plurality of stacking bins arranged in a row for stacking the mail said stacking bins each having push-out mechanisms for taking out the mail from said stacking bins, means for sorting the postal matter to said stacking bins based on the codes read out by said reading means, and a conveyance section forming a conveyance path along the row of said stacking bins for conveying in one direction the mail taken out from said stacking bins, said method comprising the steps of:

detecting mail on said conveyance path and in said stacking bins;

operating the push-out mechanisms of the stacking bins downstream the first location where there is mail both in said stacking bin and on said conveyance path so as to take out the mail from said downstream stacking bins; and operating the push-out mechanism of said stacking bin having mail opposite the location where there existed said mail on said conveyance path so as to take out the mail from said stacking bin when the conveyance path has an empty region opposite to said stacking bin due to movement of said conveyance path in said one direction.

12. The method of claim 11 wherein the steps are repeated until all mail is taken out from the stacking bins.

* * * * *